US010035252B2

(12) United States Patent
Lo

(10) Patent No.: US 10,035,252 B2
(45) Date of Patent: Jul. 31, 2018

(54) LOCKBACK TOOL WITH REPLACEABLE WORKPIECE

(71) Applicant: Yen-Fen Lo, Keelung (TW)

(72) Inventor: Yen-Fen Lo, Keelung (TW)

( * ) Notice: Subject to any disclaimer, the term of this patent is extended or adjusted under 35 U.S.C. 154(b) by 210 days.

(21) Appl. No.: 15/054,253

(22) Filed: Feb. 26, 2016

(65) Prior Publication Data

US 2017/0203428 A1 Jul. 20, 2017

(30) Foreign Application Priority Data

Jan. 14, 2016 (TW) ..... 105200511 U

(51) Int. Cl.

| | |
|---|---|
| ***B25F 1/00*** | (2006.01) |
| ***B25F 1/02*** | (2006.01) |
| ***B26B 11/00*** | (2006.01) |
| ***B66F 15/00*** | (2006.01) |

(52) U.S. Cl.

CPC ..... *B25F 1/02* (2013.01); *B25F 1/006* (2013.01); *B26B 11/00* (2013.01); *B66F 15/00* (2013.01)

(58) Field of Classification Search

CPC ... B25F 1/006; B25F 1/02; B25G 3/00; B25G 3/08; B25G 3/12; B25G 3/26; B26B 11/00; B66F 15/00

USPC ..... 7/118; 81/177.85; 30/30, 40, 29, 50–51; D8/20, 98

See application file for complete search history.

(56) References Cited

U.S. PATENT DOCUMENTS 1,021,931 A * 4/1912 James ..... B26B 23/00 30/308.1
1,810,031 A * 6/1931 Schrade ..... B26B 1/046 30/159
4,727,609 A * 3/1988 Smith, Jr. ..... B25F 1/02 124/25
4,958,395 A * 9/1990 Busskohl ..... B23D 61/121 30/144
5,664,274 A * 9/1997 Collins ..... B25F 1/003 224/904
5,685,208 A * 11/1997 Tidwell ..... B25B 23/0021 403/322.2
6,076,665 A * 6/2000 Chuang ..... A45D 29/20 206/214
6,134,788 A * 10/2000 Chen ..... B26B 1/046 30/125

(Continued)

*Primary Examiner* — Joseph J Hail
*Assistant Examiner* — Arman Milanian
(74) *Attorney, Agent, or Firm* — Bacon & Thomas, PLLC

(57) ABSTRACT

The present invention is to provide a lockback tool, which includes a workpiece body having a workpiece portion adjacent to an end thereof and a positioning slot disposed thereon adjacent to the other end thereof; a handle defining an accommodating space therein and having a resilient plate and at least one positioning stud disposed inside accommodating space so that, when the other end of workpiece body is inserted into accommodating space, positioning stud can be engaged into positioning slot; and a lockback element pivotally connected in the handle and having one end adjacent to the workpiece portion and the other end being pushed by the resilient plate so that the workpiece portion can be locked by the end of the lockback element or, when the other end being pressed by an external force against the resilient plate, the workpiece portion can be released from the end of the lockback element.

20 Claims, 5 Drawing Sheets

(56) References Cited

U.S. PATENT DOCUMENTS

| | | | | |
|---|---|---|---|---|
| 6,715,211 | B1 * | 4/2004 | Chi | B23D 51/10 30/329 |
| 2003/0112622 | A1 * | 6/2003 | Chu | A01K 97/18 362/109 |
| 2008/0229585 | A1 * | 9/2008 | Kelly | A47G 21/004 30/125 |
| 2009/0126538 | A1 * | 5/2009 | Miers | B25B 23/0035 81/177.85 |
| 2013/0007964 | A1 * | 1/2013 | Liu | B25F 1/02 7/107 |
| 2015/0217461 | A1 * | 8/2015 | Langenwalter | B26B 11/00 7/118 |

* cited by examiner

LOCKBACK TOOL WITH REPLACEABLE WORKPIECE

FIELD OF THE INVENTION

The present disclosure generally relates to a lockback tool, more particularly to a lockback tool with a replaceable workpiece.

BACKGROUND OF THE INVENTION

In recent year, with progress of technology and improvement in life quality, apart from price and endurability, people start to consider convenience, accessibility and safety of product for purchasing a novel product. Subject to the change of such market trend, various manufacturers must continuously make in an effort to develop novel and more progressive products to meet most customers' demands. A knife usually carried during an outdoor leisure activity is taken as an example below. A folding knife becomes a popular type of knife because of meeting both portability and safety, and every manufacturer pays attention in improving detail structure of the folding knife for better endurability and more smoothness in use.

Please refer to FIG. 1 which shows a schematic structural view of an inner structure of a conventional folding knife 1. The folding knife 1 includes a blade body 11 and a handle 12. The blade body 11 is pivotally connected to a position on the handle 12 and adjacent to an end of the handle 12. The handle 12 has a resilient plate 121 and a lockback element 122 inside. The resilient plate 121 has an end fixed on the handle 12 and adjacent to other end of the handle 12, and other end movably located inside the handle 12. The lockback element 122 has a middle section pivotally connected with the handle 12, an end extended to a position adjacent to an end of the blade body 11, and other end abutted against the other end of the resilient plate 121, so that the lockback element 122 can be pushed by the resilient plate 121 to enable the end of the lockback element 122 to push the end of the blade body 11 for firmly locating the blade body 11 out of the handle 12. The lockback element 122 has a press portion 123 corresponding in position to the resilient plate 121. When wanting to receive the blade body 11 into the handle 12, the user can press the press portion 123 to release the end of the lockback element 122 from the end of the blade body 11, to enable the blade body 11 to rotate towards the handle 12 for being received into the handle 12.

The conventional folding knife 1 having aforesaid structure enables the user to control the receiving of the blade body 11 conveniently by hand in a press manner. However, the inventor observes recent market trend and finds that the consumer considers not only basic factors of convenience, portability and endurability of a knife product but also the applicability of the knife product for meeting the consumer's demand, while purchasing the knife product. The reason is that the knife products are divided into more and more types, for example, types of the blades include plain edge and serrated edge. The blade with the plain edge has a smooth cutting edge for precisely cutting. The blade with the serrated edge has a larger contact area during cutting, so that the user can save force. Each of the plain edge and serrated edge has its advantage and drawback, so a knife product having part serrated edge is provided in market correspondingly.

The knife products have more sophisticated classification, so the consumer must consider purchase cost, usage and application level while purchasing the knife product. Therefore, the inventor improves the existing knife structure to design a lockback tool with replaceable workpiece, thereby reducing production cost and solving a problem that the consumer is not easy to adapt a new tool structure. In addition, the inventor further finds that other tool products (such as chisel, axe, screwdriver and so on) also have the same problem. Therefore, what is need is to improve the existing knife structure based on the concept of replaceable workpiece, so as to design a tool with easy-replaceable workpiece.

SUMMARY OF THE INVENTION

An objective of the present disclosure is to provide a lockback tool including a workpiece body, a handle and a lockback element. The workpiece body has a workpiece portion (such as blade, axe blade, saw, chisel and so on) adjacent to an end thereof, and a first engagement part disposed at a lateral thereof. The handle defines an accommodating space inside, and has a replacement opening disposed at an end thereof, cut therethrough and in communication with the accommodating space. The accommodating space is configured to match with the other end of the workpiece body. The handle has a resilient plate disposed therein and adjacent to the other end thereof and having a free end movably located in the accommodating space. The lockback element has a second engagement part disposed at an end thereof and a press portion disposed at other end thereof. A middle section of the lockback element is pivotally connected in the handle, so as to enable the second engagement part to be located in the accommodating space adjacent to the first engagement part, and enable the press portion to be located in the accommodating space and adjacent to the free end of the resilient plate, and exposed out of the handle. Under a condition that the press portion is not pressed by an external force, the free end of the resilient plate outwardly pushes the other end of the lockback element, so as to enable the second engagement part and the first engagement part to be engaged with each other and make the workpiece body being firmly combined with the handle integrally by the engagement forces of the first and second engagement parts; and under a condition that the press portion is pressed by an external force towards the accommodating space to overcome the resilient recovering force of the resilient plate, the second engagement part is turned away from the workpiece body, so that the first and second engagement parts are released from an engagement status, and the workpiece body can be drawn out from the accommodating space. Therefore, the user can simply draw out the workpiece body anytime for replacement, so as to reduce the user's purchase and maintenance cost for the lockback tool, and the manufacturer can also produce the lockback tool more flexibly.

According to one exemplary embodiment of the present disclosure, the lockback tool further includes a positioning slot and at least one positioning stud. The positioning slot is recessed on and along the other end of the workpiece body longitudinally. The at least one positioning stud is fastened in the handle and configured to be engaged into the positioning slot, and while the other end of the workpiece body is being inserted into the accommodating space through the replacement opening, a peripheral edge of the positioning stud tightly abuts against an inner wall of the workpiece body facing the positioning slot, so that the workpiece body can be more firmly combined with the handle integrally.

BRIEF DESCRIPTION OF THE DRAWINGS

The detailed structure, operating principle and effects of the present disclosure will now be described in more details hereinafter with reference to the accompanying drawings that show various embodiments of the present disclosure as follows.

DETAILED DESCRIPTION OF THE PREFERRED EMBODIMENTS

Figure 1:
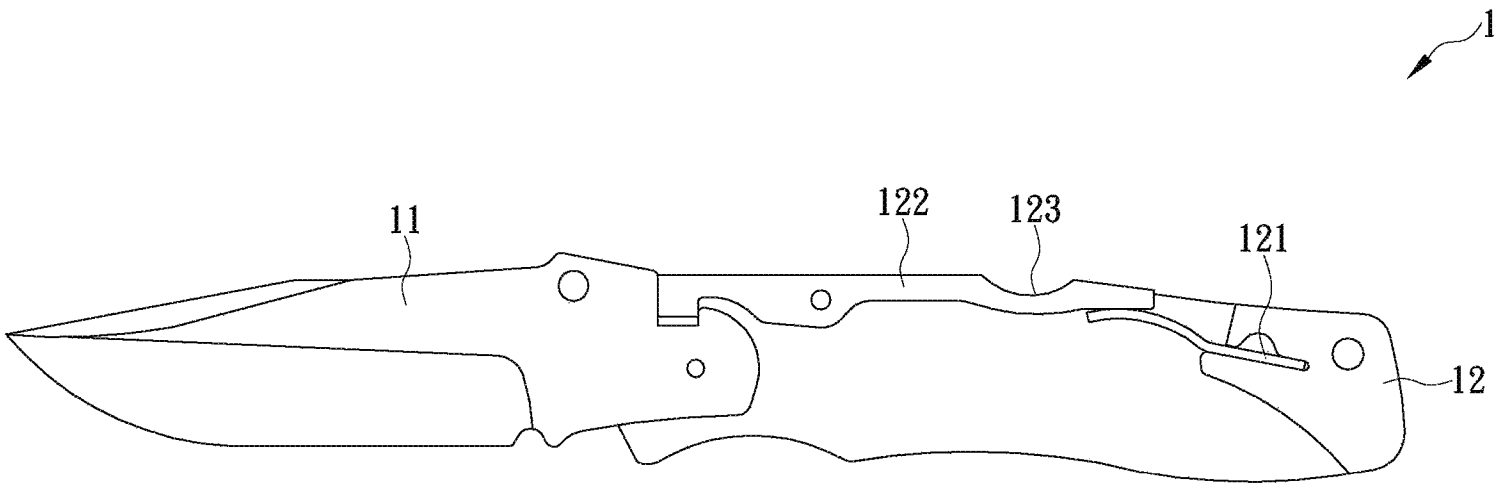
FIG. 1(Prior Art)
FIG. 1 is a schematic view of a conventional folding knife.

Reference will now be made in detail to the exemplary embodiments of the present disclosure, examples of which are illustrated in the accompanying drawings. Therefore, it is to be understood that the foregoing is illustrative of exemplary embodiments and is not to be construed as limited to the specific embodiments disclosed, and that modifications to the disclosed exemplary embodiments, as well as other exemplary embodiments, are intended to be included within the scope of the appended claims. These embodiments are provided so that this disclosure will be thorough and complete, and will fully convey the inventive concept to those skilled in the art. The relative proportions and ratios of elements in the drawings may be exaggerated or diminished in size for the sake of clarity and convenience in the drawings, and such arbitrary proportions are only illustrative and not limiting in any way. The same reference numbers are used in the drawings and the description to refer to the same or like parts.

It will be understood that, although the terms 'first', 'second', 'third', etc., may be used herein to describe various elements, these elements should not be limited by these terms. The terms are used only for the purpose of distinguishing one component from another component. Thus, a first element discussed below could be termed a second element without departing from the teachings of embodiments. As used herein, the term "or" includes any and all combinations of one or more of the associated listed items.

The present disclosure provides a lockback tool with a replaceable workpiece. Please refer to FIG. 2 which is a schematic view of a first preferred embodiment of the present disclosure. The tool 2 includes a workpiece body 21, a handle 22 and a lockback element 23. The workpiece body 21 has a workpiece portion 211 adjacent to an end thereof, and a positioning slot 210 adjacent to other end thereof and internally recessed along the workpiece body 21 in a longitudinal direction (that is a direction between two ends of the workpiece body 21), and a first engagement part 212 disposed a lateral thereof. The positioning slot 210 is in an elongate shape. In present embodiment, the workpiece body 21 is a knife, and the workpiece portion 211 may be a blade with a plain edge, a serrated edge or a part serrated edge. Unlike a common folding knife, the workpiece body 21 is not rotatable because the present disclosure claims that the workpiece body 21 can be drawn out from the lockback tool 2 conveniently for replacement.

The handle 22 is formed by assembling a first plate B1 and a second plate B2, and defines an accommodating space 220 inside, and has a replacement opening C1 located at an end thereof, cut therethrough and in communication with the accommodating space 220. The accommodating space 220 is configured to match with the other end of the workpiece body 21. The handle 22 has at least one positioning stud 221 fastened inside. In present embodiment, the positioning stud 221 is fastened on the second plate B2 and multiple in number. The positioning studs 221 are spaced apart from each other by a distance and arranged in parallel with an axial direction of the handle 22. However, it should be noted that the manufacturer can just dispose one positioning stud 221, and the single positioning stud 221 can also function normally so long as it has a certain length and volume.

The positioning stud 221 has a structure matching with a diameter of the positioning slot 210, so that the positioning stud 221 can be mounted into the positioning slot 210, and under a condition that the other end of the workpiece body 21 is inserted into the accommodating space 220 of the handle 22 through the replacement opening C1, a peripheral edge of the positioning stud 221 tightly abuts against an inner wall of the workpiece body 21 facing the positioning slot 210. The handle 22 has a resilient plate 222 disposed therein and adjacent to the other end thereof, and the resilient plate 222 has an end fastened at other end of the handle 22, and other end which is a free end and movably located in the accommodating space 220.

The lockback element 23 is in an elongate shape, and has a second engagement part 231 disposed at an end thereof and a press portion 232 disposed at other end thereof. A middle section of the lockback element 23 is pivotally connected in the handle 22 by a pivot pin 230, so that the second engagement part 231 can be located in the accommodating space 220 and adjacent to the first engagement part 212, and the press portion 232 can be located in the accommodating space 220 and adjacent to the free end of the resilient plate 222, and exposed out of the handle 22.

Figure 2:
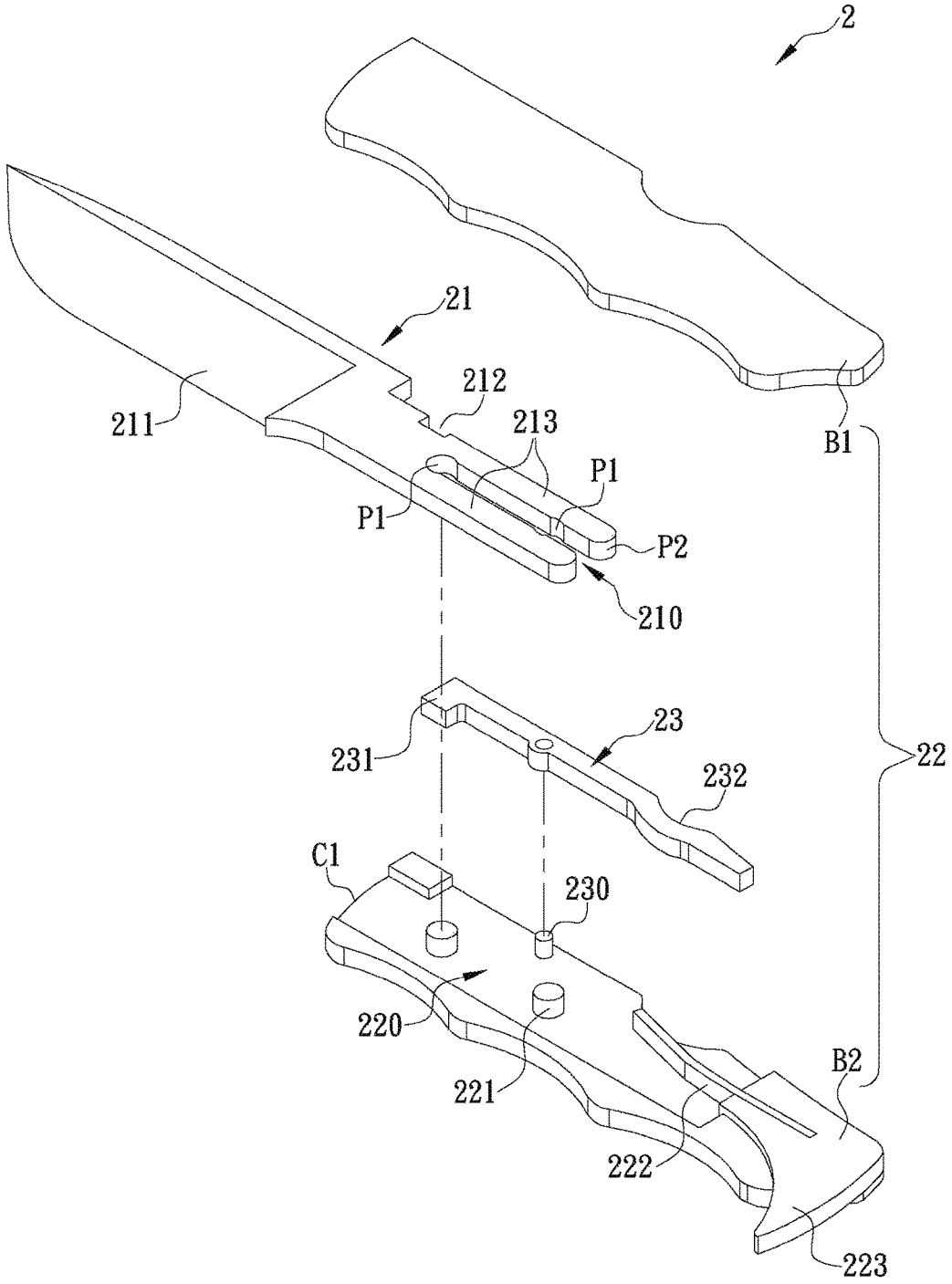
FIG. 2 is a perspective view of a lockback tool of the present disclosure.
Figure 3:
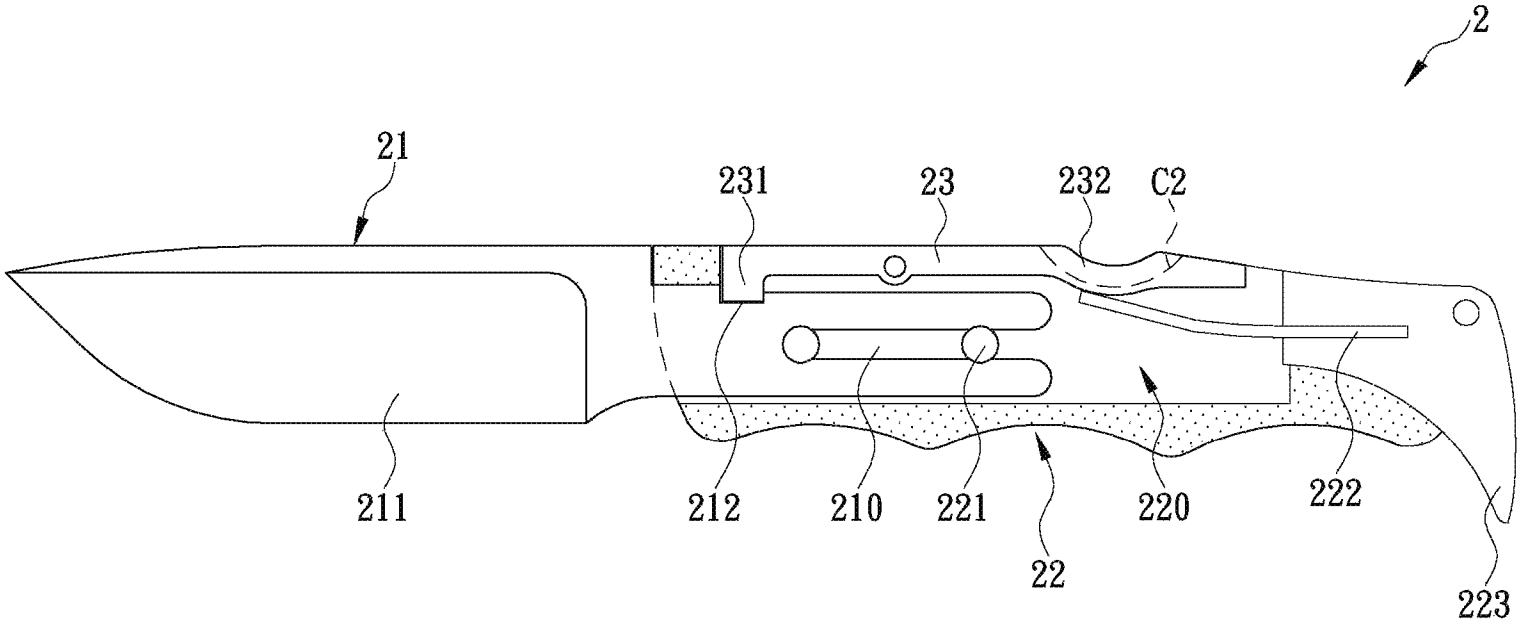
FIG. 3 is a schematic view showing an operation of the lockback tool of the present disclosure.
Figure 4:
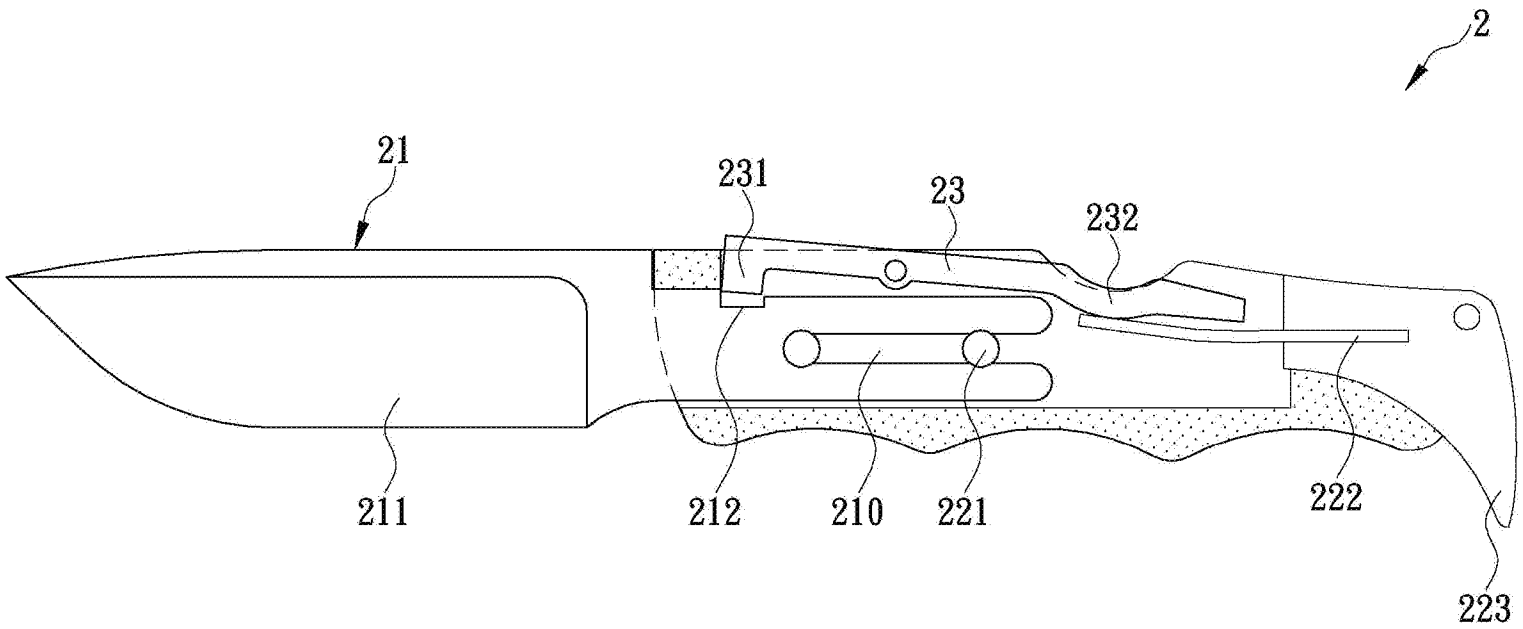
FIG. 4 is a schematic view showing other operation of the lockback tool of the present disclosure.

Please refer to FIGS. 2 through 4. Under a condition that the press portion 232 is not pressed by an external force, the free end of the resilient plate 222 outwardly pushes the other end of the lockback element 23, so as to enable the lockback element 23 to rotate about the pivot pin 230 (such as, in a counterclockwise direction shown in FIG. 3), so that the second engagement part 231 is moved towards the workpiece body 21 to enable the first and second engagement parts 212 and 231 to be engaged with each other. At this time, the workpiece body 21 is firmly combined with the handle 22 integrally.

Under a condition that the user presses the press portion 232 towards the accommodating space 220 and the user's pressing force can overcome the resilient recovering force of the resilient plate 222, the lockback element 23 can be rotated about the pivot pin 230 (such as, in a clockwise direction shown in FIG. 4), to enable the second engagement part 231 to turn away from the workpiece body 21, thereby releasing the first and second engagement parts 212 and 231 from the engagement state. At this time, the workpiece body 21 is not fastened with the first and second engagement parts 212 and 231, so the user just needs to overcome a press force between the positioning stud 221 and the positioning slot 210, to draw the workpiece body 21 out from the accommodating space 220 for replacing different workpiece body 21. The press force is a friction between the positioning stud 221 and the positioning slot 210, and the manufacturer can adjust a magnitude of the friction upon demand.

By a simple action (that is, pressing the press portion 232), the user can easily control the firm combination between the workpiece body 21 and the handle 22, and dismount and replace the workpiece body 21 anytime by a way of drawing out the workpiece body 21. Therefore, in practice, the user can just carry single handle 22, and draw out and replace different workpiece bodies 21 (such as knife, axe, chisel, screwdriver and so on) anytime to meet various demands. In addition, the user can also decrease purchase cost for many tools, and the manufacturer can produce the tools more flexibly, so as to achieve a "win-win" situation.

Figure 5:
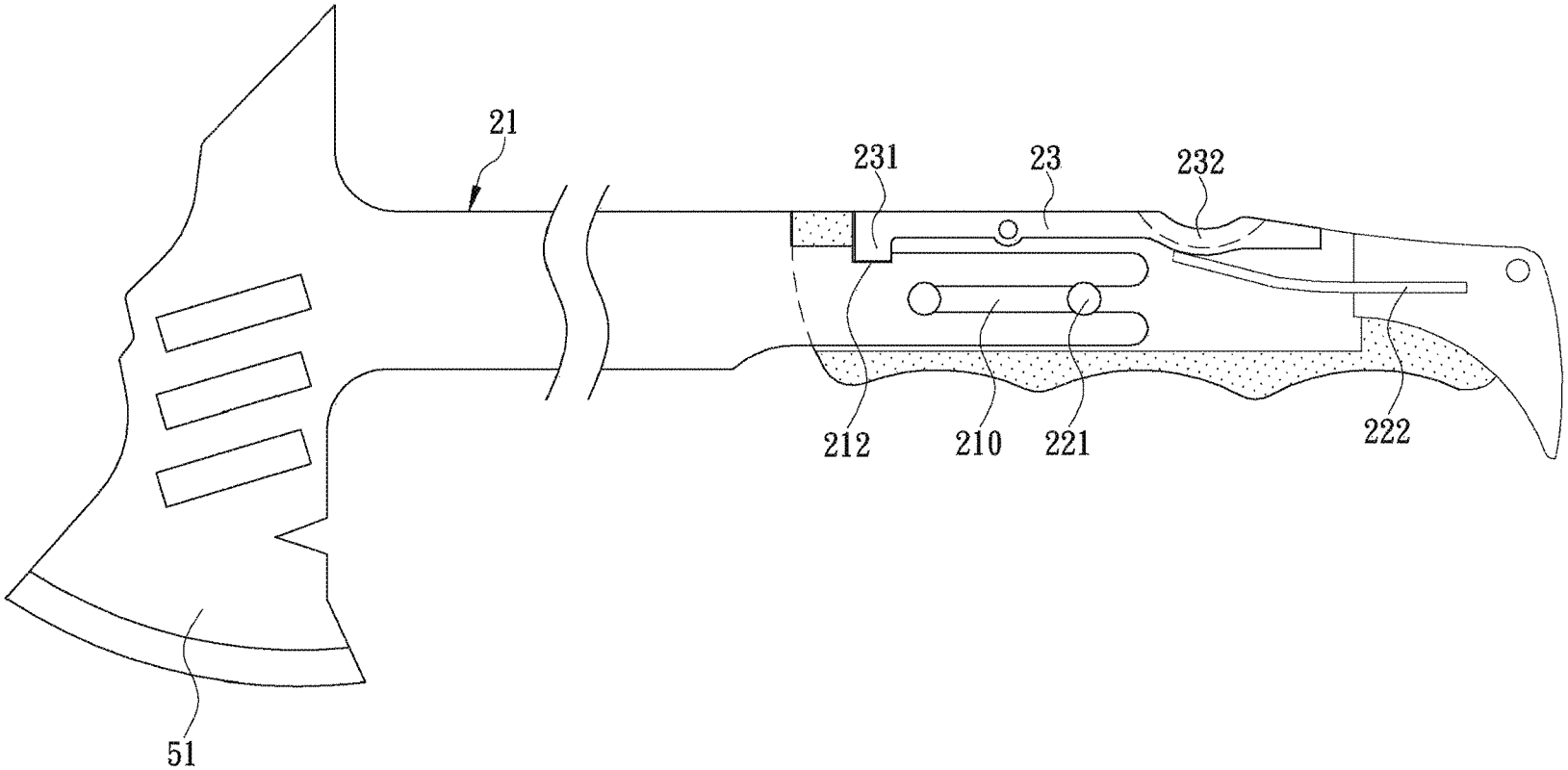
FIG. 5 is a schematic structural view of the lockback tool combined with an axe blade, in accordance with the present disclosure.

Please refer to FIG. 5 which shows a second preferred embodiment of the present disclosure. In the embodiment, the workpiece portion of the workpiece body 21 is replaced by an axe blade 51. Similarly, by the same manner, the manufacturer can replace the axe blade 51 by various tools with different shapes or types. Please refer to FIGS. 2 through 5. The manufacturer further can dispose a terminal workpiece portion 223 at the other end of the handles. The terminal workpiece portion 223 is protruded on the handle 22, and the protruding structure of the terminal workpiece portion 223 is sharp-awl-shaped, so that the other end of the handle 22 can be served as a crowbar. Alternatively, the terminal workpiece portion 223 can be designed as a hammer or a chisel.

Please refer back to FIGS. 2 and 3. The workpiece body 21 has two positioning parts 213 disposed adjacently to other end thereof and longitudinally extended along the workpiece body 21. A length of each of the positioning parts 213 can be adjusted upon demand but the positioning part 213 cannot be abutted with the other end of the lockback element 23. An outer edge of each of the positioning parts 213 is spaced apart from an inner wall of the second plate B2 and the lockback element 23 by a distance, and inner peripheries of the positioning parts 213 facing to each other are spaced apart by other distance to form the positioning slot 210. Each of the positioning parts 213 has arc surfaces P1 respectively recessed correspondingly in position to the positioning studs 221. In present embodiment, a distance between two arc surfaces P1 correspondingly facing to each other matches with a width of the positioning stud 221, so that while the positioning stud 221 is being engaged into the positioning slot 210, the positioning parts 213 can be pushed outwardly to deform until the positioning stud 221 is firmly engaged with the arc surfaces P1.

Each of the positioning parts 213 further has at least one guiding surface P2 disposed at a portion of an end thereof facing the positioning slot 210. Preferably, the guiding surface P2 can be a curve or oblique surface. Therefore, while the workpiece body 21 is being inserted into the handle 22, the positioning stud 221 can be moved along the guiding surfaces P2 to be engaged into the positioning slot 210, which can prevent from unsmooth replacement due to inaccurate positioning between the positioning stud 221 and the positioning slot 210 attributable to production error.

Please refer back to FIGS. 2 through 4. The handle 22 further has a press groove C2 corresponding in position to the press portion 232. Under a condition that the press portion 232 is not pressed by the external force, the press portion 232 can be projected out of the handle 22 through the press groove C2. Under a condition that the press portion 232 is pressed by an external force towards the accommodating space 220 to overcome the resilient recovering force of the resilient plate 222, the press portion 232 can be inserted into the accommodating space 220 through the press groove C2.

In the embodiment of the present disclosure, the workpiece body 21 is firmly combined with the handle 22 integrally by the engagement forces of the engagement parts 212 and 231 and the press force between the positioning stud 221 and the positioning slot 210. However, in practice, the manufacturer can use other design in which the workpiece body 21 and the handle 22 are fastened with each other by only the engagement force of the first and second engagement parts 212 and 231, and the effect of conveniently drawing out the workpiece body 21 for replacement can be achieved. In addition, the manufacturer also can use other manner of positioning to further enhance the strength of the positioning between the workpiece body 21 and the handle 22. For example, the other end of the workpiece body 21 can be designed to be tightly abutted against the inner wall of the handle 22; or, the workpiece body 21 has a protruding point disposed on an outer edge of the other end thereof to be engaged with the inner wall of the handle 22.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. A lockback tool, comprising:

a workpiece body having a workpiece portion adjacent to an end thereof, and a first engagement part disposed at a lateral thereof;

a handle defining an accommodating space inside and having a replacement opening disposed at an end thereof, cut therethrough and in communication with the accommodating space, wherein the accommodating space is configured to match with the other end of the workpiece body, the handle has a resilient plate disposed therein and adjacent to the other end thereof, and the resilient plate has a free end movably located in the accommodating space;

a lockback element having a second engagement part disposed at an end thereof and a press portion disposed at the other end thereof, wherein a middle section of the lockback element is pivotally connected in the handle so as to enable the second engagement part to be located in the accommodating space and adjacent to the first engagement part and enable the press portion to be located in the accommodating space adjacent to the free end of the resilient plate and exposed out of the handle;

a positioning slot recessed on and along the other end of the workpiece body longitudinally; and at least one positioning stud fastened in the handle and configured to be engaged into the positioning slot wherein, while the other end of the workpiece body is being inserted into the accommodating space through the replacement opening, a peripheral edge of the positioning stud tightly abuts against an inner wall of the workpiece body facing the positioning slot, thereby, under a condition that the press portion is not pressed by an external force, the other end of the lockback element is outwardly pushed by the free end of the resilient plate, so as to enable the second engagement part and the first engagement part to be engaged with each other and make the workpiece body being firmly combined with the handle integrally by the engagement forces of the first and second engagement parts and, under a condition that the press portion is pressed by an external force towards the accommodating space to overcome the resilient recovering force of the resilient plate, the second engagement part is turned away from the workpiece body, so that the first and second engagement parts are released from an engagement status, and the workpiece body can be drawn out from the accommodating space.

2. The lockback tool according to claim 1, wherein the workpiece body has two positioning parts disposed adjacently to the other end thereof, longitudinally extended along the workpiece body and spaced apart from each other by a distance to form the positioning slot, each of the two positioning parts has an arc surface recessed correspondingly in position to the at least one positioning stud and, while the at least one positioning stud is being engaged into the positioning slot, the two positioning parts are pushed outwardly to deform until the at least one positioning stud is engaged with the arc surfaces.

3. The lockback tool according to claim 2, wherein each of the positioning parts further has at least one guiding surface disposed at a portion of an end thereof facing the positioning slot, and the guiding surface is a curve or oblique surface.

4. The lockback tool according to claim 3, wherein the handle has a press groove corresponding in position to the press portion and, under a condition that the press portion is not pressed by the external force, the press portion is projected out of the handle through the press groove; and wherein under a condition that the press portion is pressed by an external force towards the accommodating space to overcome the resilient recovering force of the resilient plate, the press portion is inserted into the accommodating space through the press groove.

5. The lockback tool according to any one of claim 1, wherein the workpiece body is a knife and the workpiece portion is a blade or an axe blade.

6. The lockback tool according to any one of claim 2, wherein the workpiece body is a knife and the workpiece portion is a blade or an axe blade.

7. The lockback tool according to any one of claim 3, wherein the workpiece body is a knife and the workpiece portion is a blade or an axe blade.

8. The lockback tool according to any one of claim 4, wherein the workpiece body is a knife and the workpiece portion is a blade or an axe blade.

9. The lockback tool according to claim 5, wherein the positioning stud is multiple in number, and the positioning studs are spaced apart from each other by a distance, and arranged in parallel with an axial direction of the handle.

10. The lockback tool according to claim 6, wherein the positioning stud is multiple in number, and the positioning studs are spaced apart from each other by a distance, and arranged in parallel with an axial direction of the handle.

11. The lockback tool according to claim 7, wherein the positioning stud is multiple in number, and the positioning studs are spaced apart from each other by a distance, and arranged in parallel with an axial direction of the handle.

12. The lockback tool according to claim 8, wherein the positioning stud is multiple in number, and the positioning studs are spaced apart from each other by a distance, and arranged in parallel with an axial direction of the handle.

13. The lockback tool according to claim 9, wherein the handle has a terminal workpiece portion protruded at other end thereof.

14. The lockback tool according to claim 10, wherein the handle has a terminal workpiece portion protruded at other end thereof.

15. The lockback tool according to claim 11, wherein the handle has a terminal workpiece portion protruded at other end thereof.

16. The lockback tool according to claim 12, wherein the handle has a terminal workpiece portion protruded at other end thereof.

17. The lockback tool according to claim 13, wherein the terminal workpiece portion has a sharp-awl-shaped structure to be served as a crowbar.

18. The lockback tool according to claim 14, wherein the terminal workpiece portion has a sharp-awl-shaped structure to be served as a crowbar.

19. The lockback tool according to claim 15, wherein the terminal workpiece portion has a sharp-awl-shaped structure to be served as a crowbar.

20. The lockback tool according to claim 16, wherein the terminal workpiece portion has a sharp-awl-shaped structure to be served as a crowbar.

* * * * *